United States Patent [19]

Scheible

[11] Patent Number: 4,599,817

[45] Date of Patent: Jul. 15, 1986

[54] SIGNAL PISTOL

[75] Inventor: Eberhard Scheible, Geislingen, Fed. Rep. of Germany

[73] Assignee: EM-GE Sportgerate GmbH & Co., KG, Gussenstadt, Fed. Rep. of Germany

[21] Appl. No.: 582,173

[22] Filed: Feb. 21, 1984

[30] Foreign Application Priority Data

Mar. 1, 1983 [DE] Fed. Rep. of Germany ..... 3307083

[51] Int. Cl.[4] ..... F41C 3/02; F41C 25/00

[52] U.S. Cl. ..... 42/1.15; 42/15; 42/39.5; 42/87

[58] Field of Search ..... 42/1 Z, 1 G, 15, 75 B, 42/75 A, 49 R, 88, 87, 50, 39.5, 69 B, 70 R, 42 R

[56] References Cited

U.S. PATENT DOCUMENTS

| | | | |
|---|---|---|---|
| 3,270,455 | 9/1966 | Smernoff et al. | 42/1 Z |
| 3,385,163 | 5/1968 | Kotikov | 42/1 Z |
| 3,676,946 | 7/1972 | Sibilia | 42/88 |
| 4,266,357 | 5/1981 | Greenleaf | 42/1 Z |

FOREIGN PATENT DOCUMENTS

| | | | |
|---|---|---|---|
| 0088809 | 9/1983 | European Pat. Off. | 42/1 Z |
| 830465 | 1/1952 | Fed. Rep. of Germany | 42/69 B |
| 432422 | 3/1948 | Italy | 42/70 R |
| 834691 | 5/1960 | United Kingdom | 42/39.5 |
| 2079419 | 1/1982 | United Kingdom | 42/1 Z |

OTHER PUBLICATIONS

Hoffschmidt, E. J., "M40 Pistol", *NRA Illustrated Firearms Assembly Handbook*, vol. 2, The National Rifle Assoc. of America (Washington, DC, 1964), pp. 48–49.

*Primary Examiner*—Deborah L. Kyle
*Assistant Examiner*—Michael J. Carone
*Attorney, Agent, or Firm*—Walter H. Schneider

[57] ABSTRACT

The disclosure relates to a signal pistol which is furnished with a magazine for storing blank cartridges, which magazine can be transported by means of a transport latch arrangement. There is also disclosed an insert for shooting or firing of the signal rockets, which insert is in the form of a magazine slide, associated with the magazine, and having several bores. Each one of the bores communicates via a pertaining flash hole with a pertaining blank cartridge arranged in the magazine. The longitudinal axes of the bores extend at least substantially vertically or vertically slightly inclined forwardly. There can be provided two or more rows of bores in the magazine slide.

5 Claims, 6 Drawing Figures

Fig. 6
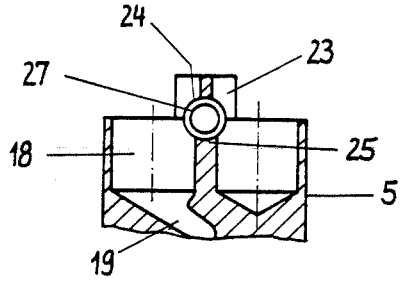
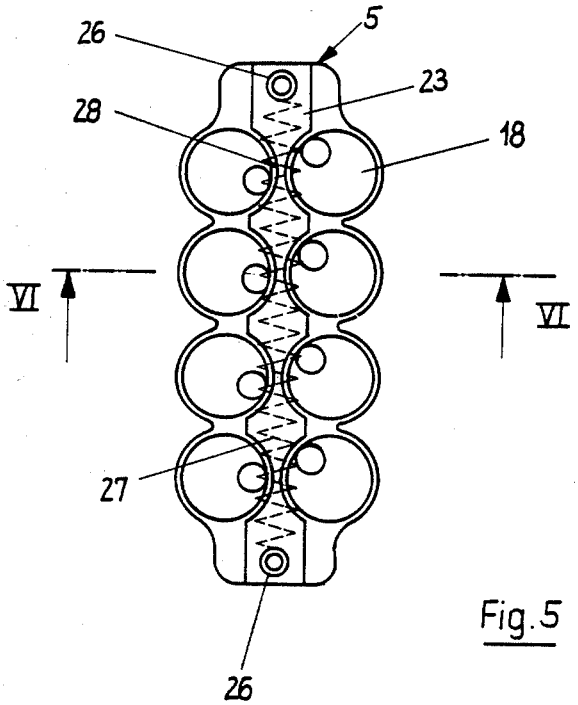
Fig. 5

SIGNAL PISTOL

BACKGROUND OF THE INVENTION

1. Field of the Invention

The present invention relates generally to improvements in or relating to signal pistols. More particularly, the present invention is concerned with a signal pistol having a magazine with blank cartridges, which magazine is transportable by means of a transport latch arrangment. The pistol also includes an insert which is connectable via at least one flash hole with the blank cartridges. The insert is furnished with bores for signal rockets, detonation-, whistle-, clatter- or similar cartridges. Such pistols, usually gas pistols and similar pistols adapted to issue signal and warning shots, serve for shooting or firing of the selected cartridges, for example, signal rockets and the like cartridges.

2. Description of the Prior Art

The known pistols are generally equipped with a magazine for receiving therein 6 mm Flobert-detonation cartridges and gas cartridges. For shooting of the signal rockets, which usually have a diameter of about 15 mm, the barrel is fitted with an insert having the desired larger bore. The pertaining insert is attached to the barrel of such pistol by means of screw threads or by being inserted with a suitably tight fit. Into the larger bore of the insert there is then introduced the signal rocket or similar device to be shot or fired by the pistol. On actuation of the pistol, the blank cartridge provides the firing spark which serves, via the flash hole, in this case provided by the barrel itself, for the firing of the signal rocket or some other utilized cartridge.

It is of disadvantage in such signal pistols, however, that after each firing a new signal rocket has to be loaded separately. Thus, the handling of such a signal pistol is relatively inconvenient on the one hand, and a rapid firing can not be carried out on the other hand.

SUMMARY OF THE INVENTION

There has continued to remain, therefore, a need for improving the signal pistol briefly described.

It is an object of the present invention to provide a signal pistol of the type briefly described which can be used to fire in a simple manner and without immediate reloading several signal rockets or other similar cartridges.

It is also an object of the present invention to provide a signal pistol which is simple in construction and which can be economically produced.

These various objects are met in accordance with the present invention thereby that the insert is provided by a magazine slide at which is arranged the magazine, which slide is furnished with several bores. Each one of the bores is connected, or in communication, with a pertaining blank cartridge, with the communication being provided by a flash hole. The pertaining longitudinal axes of the bores extend at least substantially vertically or vertically somewhat forwardly inclined.

Thus, instead of an insert with only one bore, which insert is attached to the barrel, for example by screw threads, in accordance with this invention, the insert is provided by a magazine slide or similar member having several bores. Since this magazine slide is simultaneously operatively combined with the magazine, and thereby is transported after each firing, or actuation of the pistol, in the customary manner by the transport latch arrangement, several signal rockets or the like can be fired in succession. In accordance with one aspect of the invention a number of blank cartridges is connected via pertaining flash holes with pertaining bores for the signal rockets. In the preferred way, generally there will be employed as many bores for signal rockets as there are provided blank cartridges in the magazine.

Arranging the longitudinal axes of the bores substantially vertically or slightly vertically forwardly inclined provides the advantage that the signal rockets are positioned already in the correct firing direction in the normal, substantially horizontal position of the pistol in the hand.

Of course, it is fully within the scope of the present invention that the longitudinal axes of the bores extend in the horizontal direction. In such an embodiment the cartridges will be arranged in succession one behind the other in vertical direction in the magazine. Other angles of inclination of the longitudinal axes of the bores which receive the signal devices are within the scope of this invention.

In accordance with one embodiment of the invention the magazine slide is furnished at its underside with guide grooves which, in turn, cooperate with one or several guide rails, and in a simple manner the lower or handle part of a standard gas or similar pistol for firing warning or signal shots can be used. In customary manner the magazine can be moved to the rear, in horizontal direction, by means of the transport latch arrangement. The guide bar or rail, for example, may include a base member which is connectable, via pins or rods, to the handle part of the pistol. At the base member there are provided, at the longitudinal sides thereof, horizontal guide bars which are adapted to extend into the guide grooves of the magazine slide.

Heretofore, the customary pistols comprised an upper part which is generally hingedly connected, via pins or the like, to the lower part or handle part of the pistol. Between the lower part and the upper part there is guided, in pertaining guides, the magazine which, in turn, is transported, or moved, by means of the transport latch arrangement which extends from the the handle part of the pistol. The ignition or firing of the pistol is achieved by the firing pin which also extends from the handle part.

The inventive embodiments accordingly allow readily and in a simple manner the use of the handle part of a conventional pistol of this type, whereby the connection of the base member to the handle part can be by way of the known pins or rods.

Further embodiments of the invention and other inventive features are contained in the claims.

DESCRIPTION OF THE DRAWINGS

In the drawings, which illustrate that which is presently regarded as the best mode of carrying out the invention.

FIG. 5 is a top plan view of a further embodiment of a magazine slide in accordance with the invention.

FIG. 6 is a cross section along line VI—VI in FIG. 5.

DESCRIPTION OF THE PREFERRED EMBODIMENTS

Figure 4:
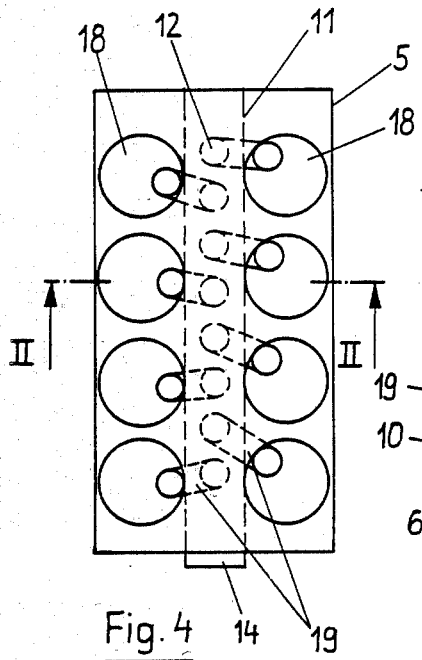
FIG. 4 is a top plan view of a magazine slide.

The lower or handle part 1 of the signal pistol is of conventional configuration and it need not be described with greater detail in here. The pistol includes a trigger 2, and a transport latch 3 extends from the handle part 1. The latch 3 serves as the transport latch arrangement. The pistol also includes a firing pin or striker 4. An insert in the form of a magazine slide 5 is arranged on the handle part 1. At its lower portion the magazine slide 5 is provided with guide grooves 6 and 7. For the direct connection of the magazine slide 5 to handle part 1 there is provided a base member 8 which is furnished on both sides with vertical walls. These vertical walls are furnished with bores, and corresponding bores are provided in the handle part 1. Pins or rods 9 are introduced through these bores so as to solidly connect the base member 8 to the handle part 1. This method of connecting corresponds to the customary connection of the known pistols to connect the upper portion of the pistol. For this reason, the customary handle part can be used without modifications in the signal piston according to the present invention.

The base member 8 is also equipped with guide bars or members 10 which are horizontally disposed along its two longitudinal sides. In the preferred embodiment, the guide bars are unitary with the base member to form a guide rail. The magazine slide 5 can be positioned on the guide bars 10 via the guide grooves 6 and 7 of the magazine slide.

A magazine 11 for receiving blank cartridges 12 is operatively connectable to the magazine slide 5. The connection is made through a linking arrangement 13 with a pin 24' which is arranged in the magazine slide 5. In this manner, the magazine 11 is swingable or foldable, in downward direction, after the magazine slide 5 is removed from the handle part 1 of the pistol. This provides the advantage that the empty cartridge cases can be pushed out in a simple manner after their use. For this, the magazine 11 is merely swung downwardly and the cartridge cases can be pushed out in forwardly direction, either by hand or using a pin or similar tool.

In order to provide for an effective connection between the magazine 11 and the magazine slide 5 there is provided an upwardly directed shoulder 14 at the forward end of the magazine slide 5. The shoulder 14 is adapted to engage the frontal wall of or fit into a correspondingly shaped depression in, the magazine slide 5. A detent arrangement including a small ball 15 is positioned in a bore in the magazine slide 5. The ball 15 is maintained under pressure by spring 16 and thus engages the corresponding surface of the shoulder 14. For retention of the ball 15 in the bore, the bore diameter is restricted after the ball 15 has been installed. This is known in the art. In this manner the ball 15 is held under tension of the spring 16 against the rearward surface of the shoulder 14, and the magazine 11 remains in the closed condition in this position.

It is of course within the scope of the present invention to provide a unitary structure which comprises the magazine slide 5 and the magazine 11. For such an embodiment it will merely be required to provide corresponding bores in the underside of the magazine slide 5.

Figure 1:
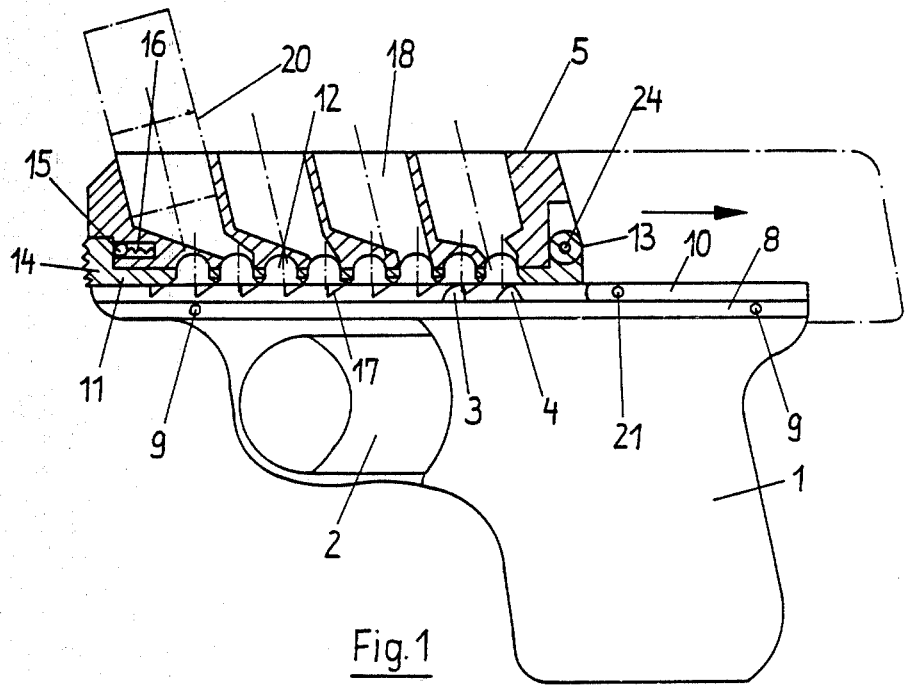
FIG. 1 is a side elevation showing one embodiment of a pistol in accordance with the invention, with some features being shown in cross section along line I—I in FIG. 2.

The transport of the magazine slide 5 for a pertaining number of shots is carried out, as is known, with teeth 17 at the magazine 11 through cooperation with which the transport latch 3 moves the magazine 11, and thereby also the magazine slide 5, after each firing of the pistol, by one step in the rearward direction (direction of arrow in FIG. 1).

Figure 2:
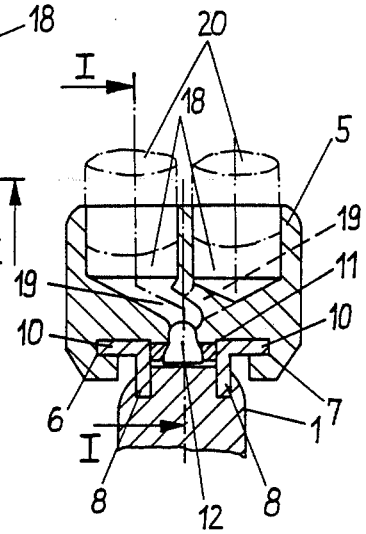
FIG. 2 is a cross section along line II—II in FIG. 4.

As is primarily evident from FIGS. 2 and 4, the magazine slide 5 is provided with two rows of bores 18, including four bores in each row. These bores 18 are to be arranged laterally above the magazine 11 and the blank cartridges 12, respectively, and there are provided correspondingly inclined extending flash holes, or detonating channels or canals, 19 to provide communication between the bores 18 and the blank cartridges 12. This arrangement allows provision of a large amount of bores for signal rockets or the like cartridges, generally indicated by the numeral 20, in a small space. Of course, it is within the scope of the invention to provide only a single row of bores 18, which row would then usefully extend directly above the magazine 11. From a practical point of view the length of the magazine slide and the magazine may be selected as desired so that, as required, even more blank cartridges, and thereby signal rockets, can be fired by the pistol without reloading of the magazine. As is indicated in FIG. 4, the flash holes 19 lead respectively in alternating manner to left and right bores 18. Thus, in the embodiment at hand, without constant reloading of these, signal rockets can be fired in a rapid sequence one after the other and alternatingly from each row, in conformity with the number of blank cartridges. Of course, different rocket types may be used whereby surprising effects can be attained.

In order to precisely guide the magazine slide 5 at the guide bars 10 there are laterally arranged one, or several, preferably two balls 21, which, together with a pertaining spring arranged behind each, have the same purpose and function as the ball 15 with the associated spring 16, as described earlier. A ball 21 extends by a short distance laterally from the surface of the pertaining guide bar 10 and provides, accordingly, a resistance to any independent shifting and accidental dropping of the magazine slide 5 from the guide bars 10 when the pistol is held in an inclined position. The selected contact pressure of the ball 21 is, however, selected so as not to affect the proper transport by the transport latch 3.

Figure 3:
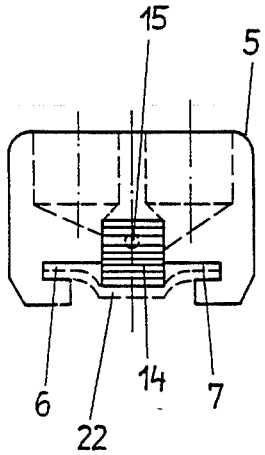
FIG. 3 is a front view of one magazine slide in accordance with the invention.

To prevent, after loading of the magazine slide 5 with blank cartridges 12, the dropping of the loaded cartridges prior to and during the sliding of the magazine slide onto the handle part 1, there can be provided a pertaining cover 22, for example, in the form of a cover made of a synthetic and/or plastic material, shown in dash outline in FIG. 3. The cover 22 extends into the grooves 6 and 7 on being inserted thereinto after the loading, during which the magazine slide 5 is held in the inverted position. When the magazine slide 5 is slid, in the position indicated in FIG. 3, from the forward end onto the handle part of the pistol, the cover 22 is shifted-out simultaneously to the same extent as the guide bars 10 are slid in.

The cover 22 is not a requirement. When it is not used the blank cartridges have to be correspondingly securely pressed into the magazine, or the pistol is correspondingly inverted to prevent dropping of the blank cartridges from the magazine when the magazine is slid on.

As is indicated in FIG. 1, the longitudinal axes of the bores 18 extend generally vertically, or slightly forwardly inclined, whereby a better direction of discharge is attained. In consideration of tolerances with respect to various signal rockets to be shot, the bores 18 are made with a slightly conical configuration.

The magazine slide 5 can be made of die cast aluminium. Die cast aluminium is very economical for quantity production and, moreover, is very form-true.

Instead of the embodiment wherein the bores 18, in which are received the signal rockets, detonation-, whistle-, or clatter cartridges, are slightly conically, so as to absorb differences in diameter of the rockets or cartridges, in accordance with the embodiments of FIGS. 5 and 6, there can be used a top guide 23. The top guide 23 is arranged between the bores 18 in the longitudinal direction of the magazine slide 5. On its underside there is provided a recess 24 having the shape of a semicylindrical groove which extends substantially over the full length of the top guide 23. The magazine slide 5, in turn, exhibits in the region beneath the top guide 23 a semicylindrical recess or groove 25 having the same length and diameter as groove 24. At its two ends the top guide 23 is screwed to the magazine slide 5 by screws 26. Into the space formed by the recesses 24 and 25 there is positioned a weak spring 27 which is secured with its two ends at the pertaining ends of the top guide 23. In the region of the bores 18, the top guide 23 is also provided with rounded apertures which are somewhat larger in size than the diameters of pertaining bores 18. In the region of the rounded apertures the top guide 23 has lateral openings 28, respectively on both sides. The diameter of the coil spring 27 is selected in such a way that portions of the coils thereof project outwardly by a short distance in the region of the lateral openings 28 from these, and thereby extend into the bores 18. Through this measure, the cartridges and rockets, respectively, are securely retained in the bores 18, because when they are introduced into the bores 18, the extensions of the spring 27 which reach into the lateral openings 28, are correspondingly tensioned by the inserted objects. Due to the spring action of the spring sections extending into the bores 18, these exert a pressure laterally in outwardly direction and hold the cartridges or rockets to a sufficient extent.

Reference in this disclosure to details of the specific embodiments is not intended to restrict the scope of the appended claims, which themselves recite those features regarded as essential to the invention.

I claim:

1. A signal rocket for repeated firing of a plurality of signal rockets without reloading the pistol which comprises a handle provided with a base member at its upper end; a trigger in said handle; a firing pin and a transport latch in said base member; a magazine slide adapted to be seated on said base member and to be transported along the longitudinal axis thereof; two parallel rows of oppositely positioned bores in said magazine slide extending longitudinally thereof for receiving signal rockets; a magazine positioned below said magazine slide provided with a plurality of cartridge seating means equivalent in number to the number of bores in said magazine slide, said plurality of seating means being in a single row extending along the longitudinal axis of said magazine slide with each seating means being connected by an obliquely inclined flash hole to a bore in a row of bores opposite to the row to which the seating means adjacent to it is connected; and means associated with said magazine and cooperating with said transport latch whereby said magazine together with said magazine slide can be progressively moved rearwardly along the longitudinal axis of said base member so as to successively bring each cartridge seating means in contact with said firing pin thereby permitting repeated firings of signal rockets from said bores in said magazine slide.

2. A signal pistol for repeated firing of a plurality of signal rockets without reloading the pistol which comprises a handle provided with a base member at its upper end; a trigger in said handle; a firing pin and a transport latch in said base member; a magazine slide adapted to be seated on said base member and to be transported along the longitudinal axis thereof; a plurality of bores in said magazine slide for receiving signal rockets positioned in two parallel rows with their axes essentially vertical to the axis of the magazine slide; a guide along the magazine slide between the parallel rows of bores cooperating with a groove in the top of said magazine slide to form a space communicating through lateral openings with said bores; a spring in said space, portions of which extend into said lateral openings; a magazine associated with said magazine slide provided with means for seating a plurality of cartridges equivalent in number to the number of bores in said magazine slide; a flash hole extending from each bore in said magazine slide, each such hole providing communication between its bore and a cartridge in said seating means; and means associated with said magazine and cooperating with said transport latch whereby said magazine together with said magazine slide can be progressively moved rearwardly along the longitudinal axis of said base member after the firing of each rocket thereby permitting repeated firings of signal rockets from said bores in said magazine slide.

3. A signal pistol for repeated firing of a plurality of signal rockets without reloading the pistol which comprises a handle provided with a base member at its upper end; a trigger in said handle; a firing pin and transport latch in said base member; a magazine slide adapted to be seated on said base member and to be transported along the longitudinal axis thereof; a plurality of bores in said magazine slide for receiving signal rockets; a magazine associated with said magazine slide provided with means for seating a plurality of cartridges equivalent in number to the number of bores in said magazine slide, said magazine being linked by one of its ends to the underside of one end of said magazine slide whereby it can be swung away from said magazine slide when the latter is separated from said base member thereby providing access to said bore holes from the underside of said magazine slide; a flash hole extending from each bore in said magazine slide, each such hole providing communication between its bore and a cartridge in said seating means; and means associated with said magazine and cooperating with said transport latch whereby said magazine together with said magazine slide can be progressively moved rearwardly along the longitudinal axis of said base member after the firing of each rocket thereby permitting repeated firings of signal rockets from said bores in said magazine slide.

4. A signal pistol according to claim 3 in which the other end of said magazine is provided with an upwardly projecting shoulder adapted to engage the other end of said magazine slide.

5. A signal pistol according to claim 4 in which the other end of said magazine slide is provide with a ball and spring assembly in which said ball is kept under spring pressure against said shoulder of said magazine.

* * * * *